US011426850B2

(12) United States Patent
Lefavour et al.

(10) Patent No.: US 11,426,850 B2
(45) Date of Patent: Aug. 30, 2022

(54) PORTABLE HAND HELD POWER TOOL WITH INTERCHANGEABLE HEAD

(71) Applicant: Hubbell Incorporated, Shelton, CT (US)

(72) Inventors: John David Lefavour, Litchfield, NH (US); Thomas Romeo Faucher, Manchester, NH (US); Lawrence Brown, Allenstown, NH (US); Peter Matthew Wason, Manchester, NH (US); Bernard P. Vachon, Londonderry, NH (US); Sarah LaPerriere, Shelton, CT (US); Mark A. Chiasson, Merrimack, NH (US)

(73) Assignee: HUBBELL INCORPORATED, Shelton, CT (US)

( * ) Notice: Subject to any disclaimer, the term of this patent is extended or adjusted under 35 U.S.C. 154(b) by 334 days.

(21) Appl. No.: 16/201,551

(22) Filed: Nov. 27, 2018

(65) Prior Publication Data

US 2019/0160639 A1 May 30, 2019

Related U.S. Application Data

(60) Provisional application No. 62/591,313, filed on Nov. 28, 2017.

(51) Int. Cl.
*B25B 27/14* (2006.01)
*H01R 43/042* (2006.01)

(52) U.S. Cl.
CPC ..... *B25B 27/146* (2013.01); *H01R 43/0427* (2013.01)

(58) Field of Classification Search
CPC ..... B25B 27/146; B25B 27/10; B21D 39/046; B21D 39/048; H01R 43/042; H01R 43/0427; Y10T 279/17752; B23B 31/1071
(Continued)

(56) References Cited

U.S. PATENT DOCUMENTS 2,265,267 A * 12/1941 Cowles ..... F16L 37/46 251/149.6
2,428,638 A * 10/1947 Scheiwer ..... F16L 37/23 137/614.04

(Continued)

FOREIGN PATENT DOCUMENTS

EP 2079562 7/2009
GB 2375981 12/2002

OTHER PUBLICATIONS

International Search Report and Written Opinion dated in PCT/US2018062617 dated Feb. 8, 2019.

(Continued)

*Primary Examiner* — Adam J Eiseman
*Assistant Examiner* — Fred C Hammers
(74) *Attorney, Agent, or Firm* — Wissing Miller LLP

(57) ABSTRACT

Portable, hand held, battery operated, hydraulic tools are provided with a tool frame and one or more interchangeable working heads. When the working head is connected with the tool frame, a piston actuated by a hydraulic system within the tool frame applies force to the working head to perform a task. A coupling mechanism holds the working head to the tool frame. The coupling mechanism allows the working head to be removed from the tool frame and another working head to be joined to the tool frame. The coupling mechanism can hold the working head at a fixed rotational angle with respect to the tool frame. The coupling mechanism can also allow the working head to rotate with respect to the tool frame.

11 Claims, 11 Drawing Sheets

(58) Field of Classification Search
USPC ..... 72/413
See application file for complete search history.

(56) References Cited

U.S. PATENT DOCUMENTS

| | | | | |
|---|---|---|---|---|
| 2,727,759 | A * | 12/1955 | Elliott | F16L 37/23 251/149.6 |
| 3,106,379 | A * | 10/1963 | Carlo | F16L 37/23 251/149.9 |
| 3,973,179 | A | 8/1976 | Weber | |
| 4,873,755 | A * | 10/1989 | Johnston | B21D 39/048 29/237 |
| 5,003,847 | A * | 4/1991 | Wagner | B25B 21/00 81/57.39 |
| 5,027,489 | A * | 7/1991 | Johnston | B23P 19/027 29/237 |
| 5,103,696 | A * | 4/1992 | Beuke | B25B 21/005 81/57.39 |
| 5,195,042 | A | 3/1993 | Ferraro et al. | |
| 5,951,026 | A * | 9/1999 | Harman, Jr. | B25B 21/007 279/143 |
| 6,000,888 | A | 12/1999 | Hartman | |
| 6,015,171 | A * | 1/2000 | Schorn | F16L 37/12 251/148 |
| 6,039,126 | A * | 3/2000 | Hsieh | B25B 21/00 173/170 |
| 6,079,716 | A * | 6/2000 | Harman, Jr. | B23Q 3/12 279/143 |
| 6,170,579 | B1 | 1/2001 | Wadge | |
| 6,178,870 | B1 | 1/2001 | Takahashi | |
| 6,254,303 | B1 * | 7/2001 | Falat | B23Q 3/12 279/143 |
| 6,672,788 | B2 * | 1/2004 | Hathaway | F16C 11/0619 403/132 |
| 6,718,870 | B1 * | 4/2004 | Frenken | B25B 27/10 100/102 |
| 8,667,908 | B2 * | 3/2014 | Martin | B25B 23/0035 |
| 9,027,969 | B2 * | 5/2015 | Lin | F16L 37/084 285/402 |
| 9,242,422 | B2 * | 1/2016 | Schweizer | B25B 23/0035 |
| 9,434,119 | B2 * | 9/2016 | Schweizer | B30B 15/026 |
| 9,573,263 | B2 | 2/2017 | Bowles et al. | |
| 2002/0050368 | A1 | 5/2002 | Driessen | |
| 2007/0295053 | A1 | 12/2007 | Ruland | |
| 2008/0135048 | A1 * | 6/2008 | Witt | F16L 37/40 128/205.24 |
| 2011/0203819 | A1 | 8/2011 | Tsai | |
| 2011/0272172 | A1 | 11/2011 | Lau et al. | |
| 2012/0319398 | A1 | 12/2012 | Schweizer et al. | |
| 2013/0008677 | A1 | 1/2013 | Huifu | |
| 2013/0240228 | A1 | 9/2013 | Lefavour et al. | |
| 2013/0264085 | A1 | 10/2013 | Ciotti | |
| 2014/0047885 | A1 | 2/2014 | Battenfeld et al. | |
| 2014/0332243 | A1 | 11/2014 | Baskar et al. | |
| 2015/0059529 | A1 | 3/2015 | Franken | |
| 2015/0272569 | A1 | 10/2015 | Leimbach | |
| 2015/0343583 | A1 | 12/2015 | McRoberts et al. | |
| 2016/0167186 | A1 | 6/2016 | Chan et al. | |
| 2016/0252112 | A1 | 9/2016 | Kehoe et al. | |
| 2017/0057040 | A1 | 3/2017 | Rzasa et al. | |
| 2017/0087709 | A1 | 3/2017 | Barezzani | |
| 2017/0302044 | A1 | 10/2017 | Lefavour et al. | |

OTHER PUBLICATIONS

Emerson Brochure for RIDGID "Electrician and Utility Tools", pp. 1-27, 2018.

Emerson Manual for Electical Tools RE 6/RE 60.RE 600; pp. 1-90, Dec. 2017.

* cited by examiner

PORTABLE HAND HELD POWER TOOL WITH INTERCHANGEABLE HEAD

This application claims priority under 35 U.S.C. § 119 to U.S. Provisional Patent Application No. 62/591,313, filed on Nov. 28, 2017. The disclosure of that application is incorporated herein by reference.

BACKGROUND

Field

The present disclosure relates to power tools and, more particularly, to portable, hand-held power tools with interchangeable heads.

Description of the Related Art

Portable, handheld power tools are used to perform a variety of tasks. Such tools include a power source such as a battery, an electric motor, and a working component, such as a saw, cutting blade, grinding wheel, or crimper. Some portable tools incorporate a hydraulic pump to drive a piston to apply a relatively large amount of force or pressure for a particular task. Some of these hydraulic tools include a working head with working surfaces shaped to perform a particular action on a workpiece, for example, crimping or cutting. Force from the piston actuated by the hydraulic system is applied to the workpiece to perform the desired task.

Battery powered hydraulic tools are employed in numerous applications to provide an operator with a desired flexibility and mechanical advantage. For example, an operator of a hydraulic power tool equipped with a head having a cutting blade can cut large conductors e.g., #8 conductors and larger. Likewise, an operator using a hydraulic tool equipped with a head including crimping surfaces can use the tool to make crimped connections on large conductors.

Many hydraulic tools require relatively expensive components to provide sufficient power, durability, and reliability for industrial and commercial tasks. Such tools may also require strong components to withstand significant forces required to perform industrial processes. Thus, such tools may be expensive, heavy, and bulky.

SUMMARY

The present disclosure provides exemplary embodiments of hydraulic power tools with a tool frame that can be connected with interchangeable heads. Such tools allow an operator to change the function of a single tool frame so the same tool frame can perform a variety of different tasks. This may reduce the expense required to equip the user because a single tool frame can be joined with different working heads to perform different tasks. Using interchangeable working heads on a single tool frame may also reduce the weight and bulk of the equipment a user must bring to the job site.

A tool according to the disclosure include a tool frame and a working head. The working head may include an impactor element that is driven by a hydraulic actuator on the tool frame and an anvil against which a workpiece is pressed as the impactor element is driven. Interchangeable heads with different impactors and anvils are provided for performing a variety of tasks, including crimping and cutting workpieces. In addition, the impactor and anvil of a working head may themselves be interchangeable to perform different functions or may support dies for shaping workpieces.

In one embodiment, a hand-held hydraulic tool includes a tool frame and an interchangeable working head configured with elements to perform a particular task, e.g., crimping a particular type of crimp to join electrical conductors. The tool frame includes a coupling mechanism for removably connecting the tool with the working head so that force delivered by a hydraulically driven piston of the tool actuates working surfaces of the head to perform the task. The working head includes structures to engage with a coupling mechanism on the tool frame and securely connect the head with the tool frame. To secure the working head to the tool frame, a locking mechanism may be provided that secures the coupling mechanism from inadvertently allowing the head to uncouple from the tool until the operator chooses to remove the head.

BRIEF DESCRIPTION OF THE DRAWINGS

A more complete appreciation of the present disclosure and many of the attendant advantages thereof will be readily obtained as the same becomes better understood by reference to the following detailed description when considered in connection with the accompanying drawings, wherein:

FIG. 2 is a front perspective view of the working head and a portion of the main body of the embodiment of FIG. 1, illustrating the working head separate from the tool frame;

DETAILED DESCRIPTION

Figure 1:
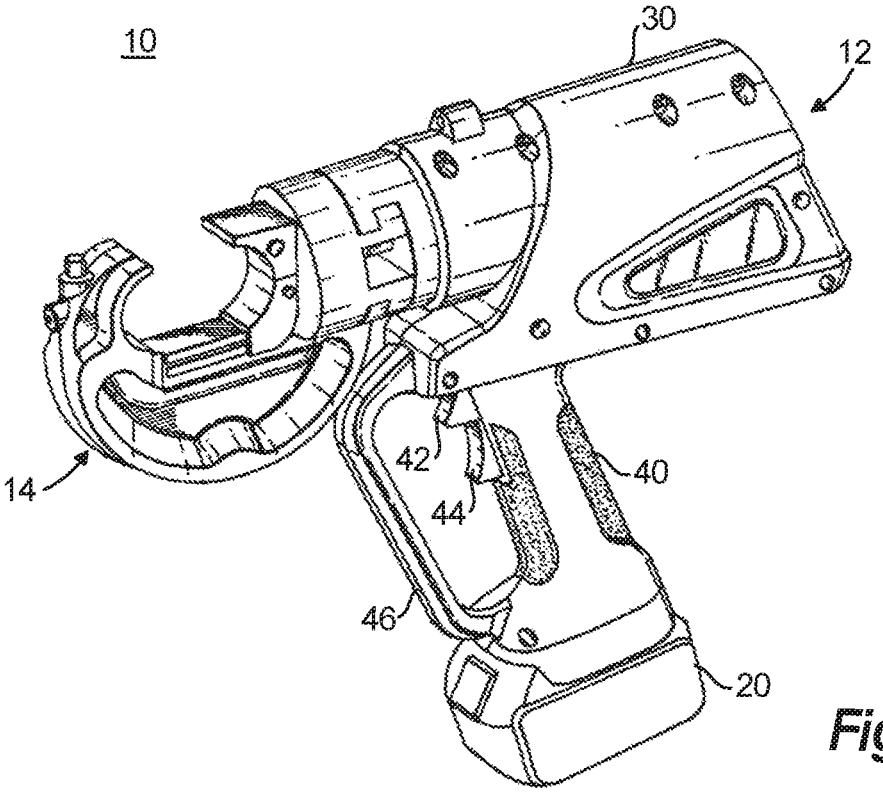
FIG. 1 is a front perspective view of an exemplary embodiment of a tool according to the present disclosure illustrating a tool frame connected with a working head of the tool.

Illustrative embodiments of the present disclosure may be provided as improvements to portable, hand held, battery operated, hydraulic tools and one or more interchangeable working heads for performing different tasks.

FIGS. 1-4 show an exemplary embodiment of a hydraulic power tool 10 according to the present disclosure. The tool 10 includes a tool frame 12 and a working head 14. Within the frame 12, and not shown here, is a battery driven hydraulic system. Such a system may comprise a pump, motor, fluid reservoir, controller and hydraulic drive conduit system. An exemplary embodiment of such a hydraulic system is shown in co-pending U.S. patent application Ser. No. 15/429,869, which issued as U.S. Pat. No. 10,109,971 on Oct. 23, 2018, and which is incorporated herein by reference. Battery 20 provides electrical power to the hydraulic system. Piston 60 is driven by the hydraulic system to provide force in the distal direction to the working head 14. The tool frame 12 includes a main body 30 and a handle 40 that form a pistol-like shape. However, the tool frame 12 could be in any suitable type of shape.

The battery 20 is removably connected to the bottom of the handle 40. In another embodiment, the battery 20 could be removably mounted or connected to any suitable position on the tool frame 12. In another embodiment, the battery 20 may be affixed to the tool 10 so that it is not removable. The battery 20 is preferably a rechargeable battery, such as a lithium ion battery, that can output a voltage of at least 16 VDC, and preferably in the range of between about 16 VDC and about 24 VDC. In the exemplary embodiment shown in FIG. 1, the battery 20 can output a voltage of about 18 VDC.

Figure 3:
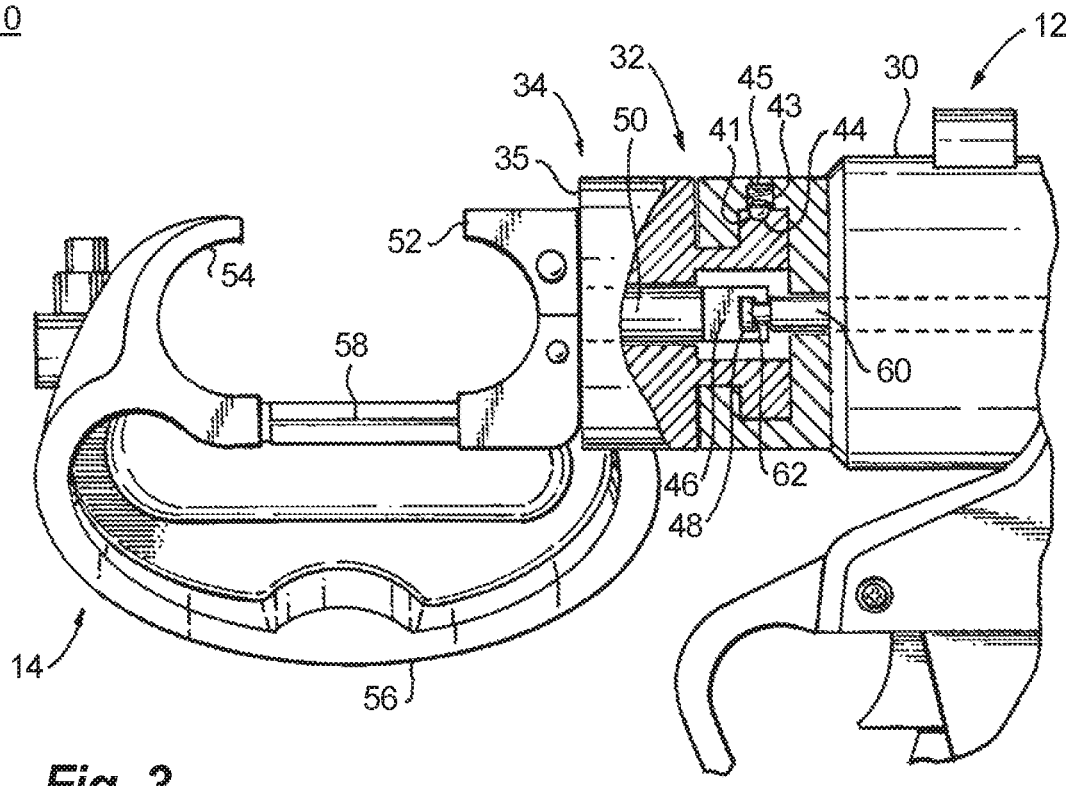
FIG. 3 is a side elevation view of the working head and cross section of a portion of the main body of the embodiment of FIG. 1 with the tool in a home position.
Figure 4:
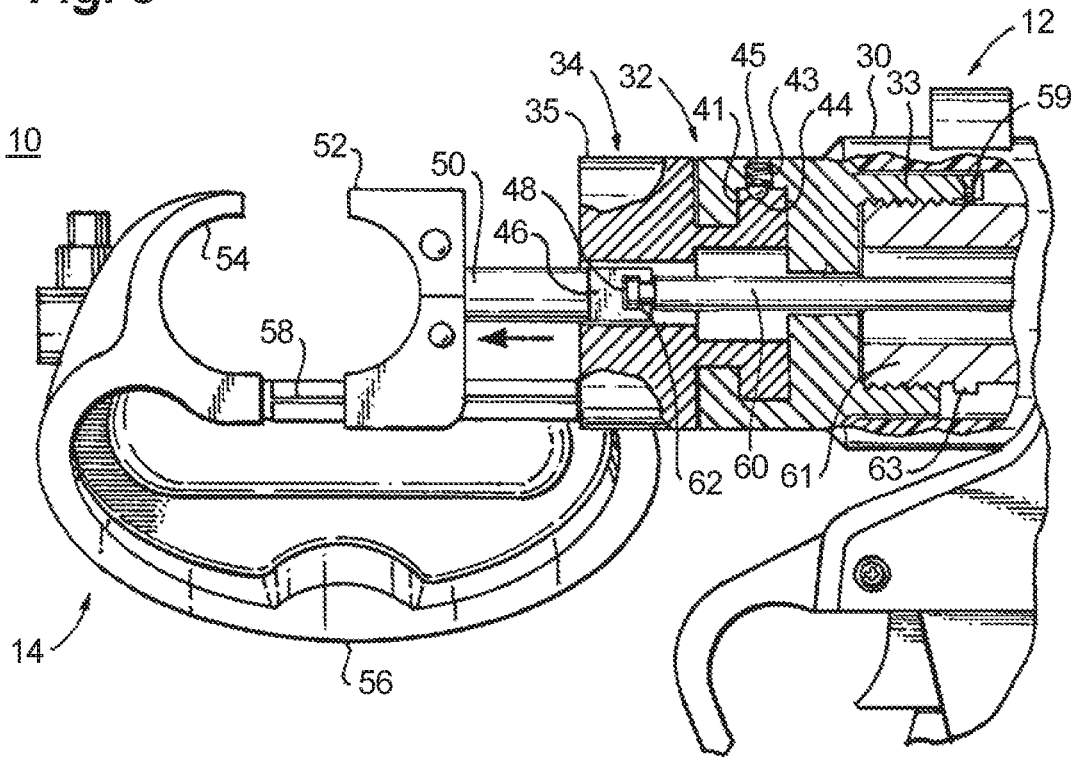
FIG. 4 is a side elevation view of the working head and cross section of a portion of the main body of the embodiment of FIG. 1 with the tool in an actuated position.
Figure 5:
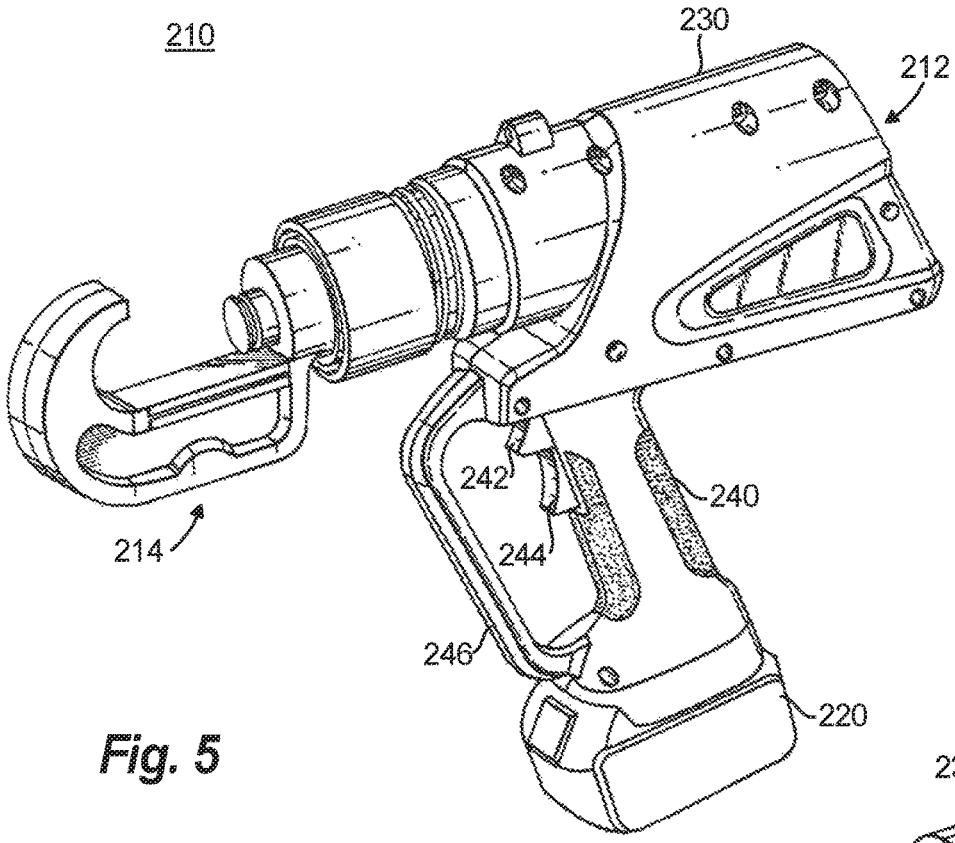
FIG. 5 is a front perspective view of another exemplary embodiment of a tool according to the present disclosure illustrating a tool frame connected with a working head of the tool.

The handle 40 includes one or more operator controls, such as trigger switches 42 and 44, which can be manually activated by an operator. The handle 40 may include a hand guard 46 to protect an operator's hand while operating the tool 10 and to prevent unintended operation of trigger switches 42 and 44. According to an embodiment of the present disclosure, one of the trigger switches (e.g., trigger switch 42) may be used to pressurize hydraulic cylinder 61 to drive the piston 60 in the distal direction, as shown in FIG. 4, to deliver force to the working head to perform a task, such as crimping or cutting. The other trigger switch (e.g., trigger switch 44) may be used to depressurize hydraulic cylinder 61 to retract the piston 60 in the proximal direction to the home position, shown in FIGS. 1 and 3.

As shown in FIG. 2, the working head 14 is separable from the main body 30. The main body 30 includes a tool connecting portion 32. Working head 14 includes a head connecting portion 34. The tool connecting portion 32 includes a T-shaped slot 36. The head connecting portion 34 includes upper and lower connecting arms 38, 39 connected with a ring 35. In operation, piston 60 provides force to a drive shaft 50 distally, as shown in FIG. 4, to deliver force to a workpiece. The connecting arms 38, 39 are L-shaped, with upper extension 40 extending upward from the top connecting arm 38 and lower extension 41 extending downward from the lower connecting arm 39. The cross section of the connecting arms 38, 39 and extensions 40,41 correspond to the cross section of the T-shaped slot 36 so that when the head connecting portion 34 is aligned with the tool connecting portion 32, the arms 38, 39 and extensions 40, 41 slide into the T-shaped slot 36, as shown in FIG. 2. FIGS. 3 and 4 show cross sectional views of the working head 14 connected with the main body 30.

To prevent the working head 14 from inadvertently disconnecting from the main body 30, a locking mechanism 42 is provided on the tool connecting portion 32 that engages a hole 44 on a top surface of extension 40 of connecting arm 38 of the head connecting portion 34. As shown in cross section in FIGS. 3 and 4, the locking mechanism 42 includes a ball 41 within a blind hole 45 in contact with the lower end of a spring 43. The upper end of the spring 43 contacts the closed end of the blind hole 45. The diameter of the open end of the blind hole 45 is slightly smaller than the diameter of the ball 41 so the ball extends partway out of the hole 45 but remains captive in the hole 45. The spring forces the ball 41 downward to extend partially from blind hole 45. When the head 14 is engaged with the main body 30, hole 44 on the head engagement portion 34 aligns with hole 45 of the tool engagement portion 32. Ball 41 engages with hole 44. Engagement of the ball 41 with hole 44 inhibits movement of the working head 14 in the direction of T-shaped slot 36. To remove head 14 from main body 30, sufficient force must be applied along the direction of T-shaped slot 36 to force the ball 41 upward against the force of spring 43 to disengage the ball 41 from hole 44.

As shown in FIGS. 3 and 4, working head 14 includes drive shaft 50 and piston connector 46. Piston connector 46 includes a T-shaped slot 48. The axis of slot 48 is aligned with the axis of T-shaped slot 36 on the main body 30. A groove 62 is provided near the distal end of the piston 60. The distal end of the piston 60 thus forms a region with a T-shaped cross section. The T-shaped slot 48 of the piston connector 46 engages with the distal end of the piston 60 when the connecting arms 38, 39 of the working head 14 are slid into T-shaped slot 36. As shown in FIG. 4, motion of piston 60 in the distal direction is communicated to the working head 14 by the piston connector 46 and drive shaft 50. As shown in FIG. 3, when the piston 60 returns to the home position, drive shaft 50 is retracted.

The drive shaft 50 connects with impactor 52. The impactor 52 engages with a guide 58 on arm 56. When the working head 14 is connected to the main body 30 and the piston 60 is driven in the distal direction, drive shaft 50 forces the impactor 52 along guide 58, as shown in FIG. 4. Arm 56 is connected at its proximal end with the ring 35. At its distal end, arm 56 supports an anvil surface 54. When a workpiece is placed between the impactor 52 and anvil surface 54 and the piston 50 is driven in the distal direction, the impactor 52 and anvil 54 deform the workpiece, for example, to install a crimp or to cut the workpiece.

Force applied by the piston 60 to the head 14 is resisted by a reaction force between the distal surfaces of extensions 40, 41 on the head 14 and proximal surfaces of the T-shaped slot 36 on the main body 30 that abut extensions 40, 41. In the embodiment shown in FIGS. 1-4, the T-shaped slot 36 engages the distal surfaces of extensions 40 and 41 in a plane perpendicular to the axis of the piston. Thus, the reaction force of the head 14 in response to the driving force of the piston 60 is normal to the plane where the arms 40, 41 contact the T-shaped slot 36. According to another embodiment, the distal-facing surfaces of extensions 40, 41 and the corresponding proximal-facing surfaces of the T-shaped slot 36 are at an angle oblique to the axis of the piston. According to one aspect, the oblique angle of the distal-facing surfaces of extensions 40 and 41 is in the distal direction with respect to the axis of the piston to reduce a tendency of the top and bottom of the T-shaped slot 36 to splaying outward in response to the reaction force when force is applied to the head 14 by piston 60.

According to the embodiment shown in FIGS. 1-4, the impacting tool 52 and anvil 54 are shaped to deform a workpiece into a substantially circular cross section, for example, to install a crimp connector joining two connectors. According to further embodiments, the impactor 52 and anvil 54 may be formed in a variety of shapes and configured for other tasks, for example, to provide a cutter for cutting a workpiece, or to hold dies to shape a workpiece.

Tool connecting portion 32 is rotatable with respect to main body 30. Internal threads 33 are provided on the proximal inside surface of connecting portion 32. These threads engage with threads on the distal outer surface of hydraulic cylinder 61. During assembly, threaded portion 33 of tool connecting portion 32 is threaded onto the hydraulic cylinder 61. Set screw 59 is then installed in a threaded hole near the proximal end of tool connecting portion 32. A stop 63 is provided on the outer surface of hydraulic cylinder 61. When set screw 59 is installed in connecting portion 32, the set screw allows connecting portion 32 to rotate almost one complete rotation with respect to cylinder 61 before encountering the stop. This prevents tool connecting portion 32 from unscrewing from cylinder 61.

According to the embodiment of FIGS. 1-4, the tool connector portion 32 and head connector portion 34 have a circular profile. According to another embodiment, the profile of the connector portions 32, 34 can be square, rectangular or other shape.

FIGS. 5-8 show another embodiment according to the disclosure. Hydraulic power tool 210 includes a tool frame 212, handle 240, and battery driven hydraulic system similar to the embodiment described with respect to FIGS. 1-4. Working head 214 removably connects with the main body 230 so that different working heads 214 can be interchangeably connected with the frame 212.

Figure 6:
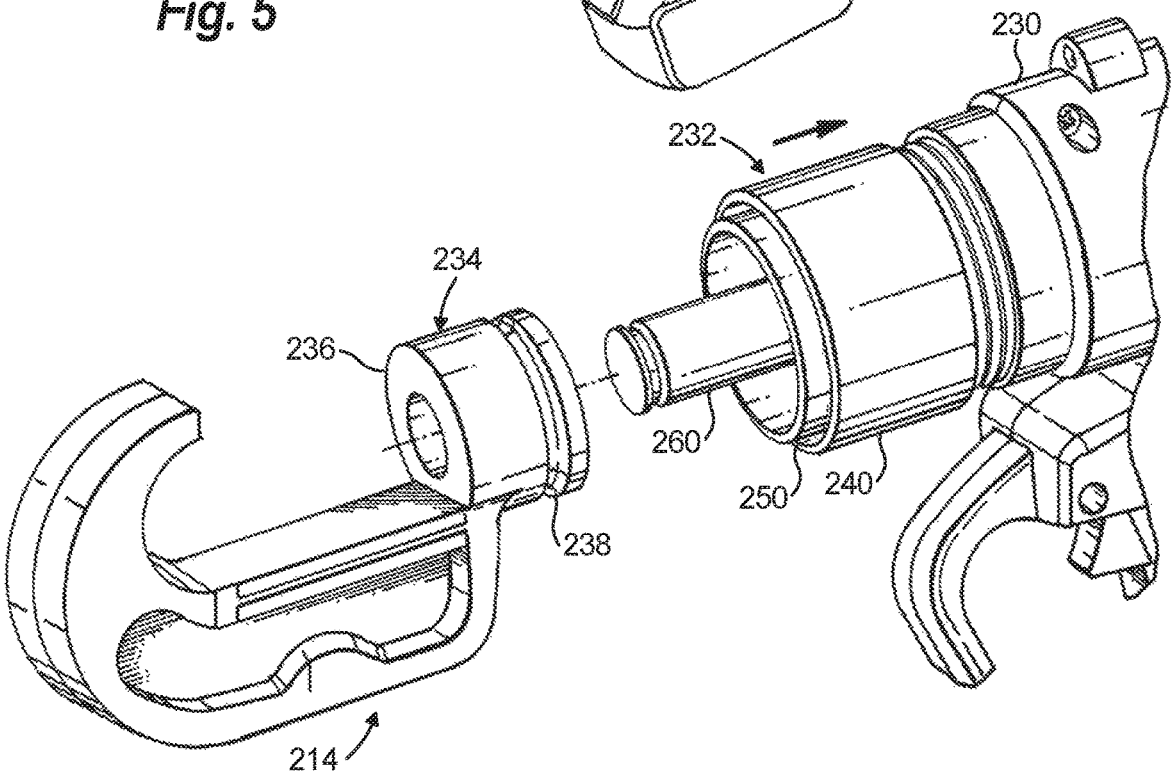
FIG. 6 is a front perspective view of the working head and a portion of the main body of the embodiment of FIG. 5 illustrating the working head separate from the tool frame.
Figure 8:
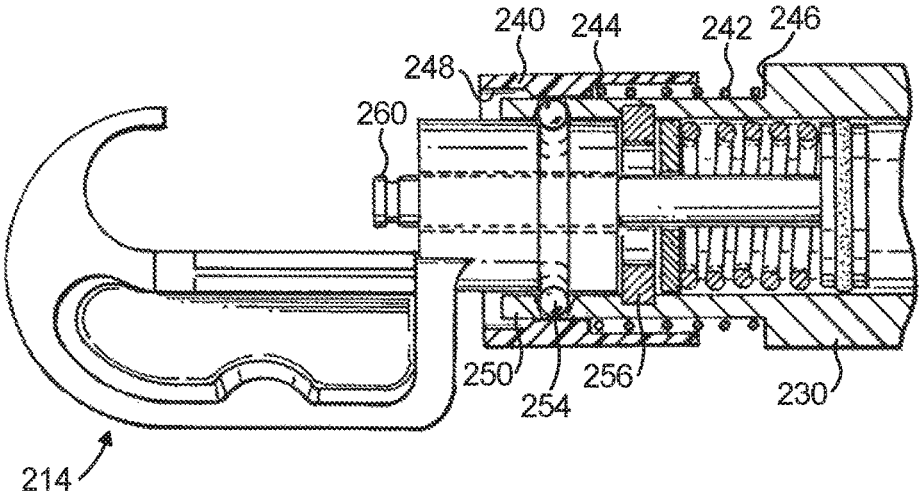
FIG. 8 is a side elevation view of the working head and cross section of a portion of the main body of the embodiment of FIG. 5 with the head connected with the main body.
Figure 9:
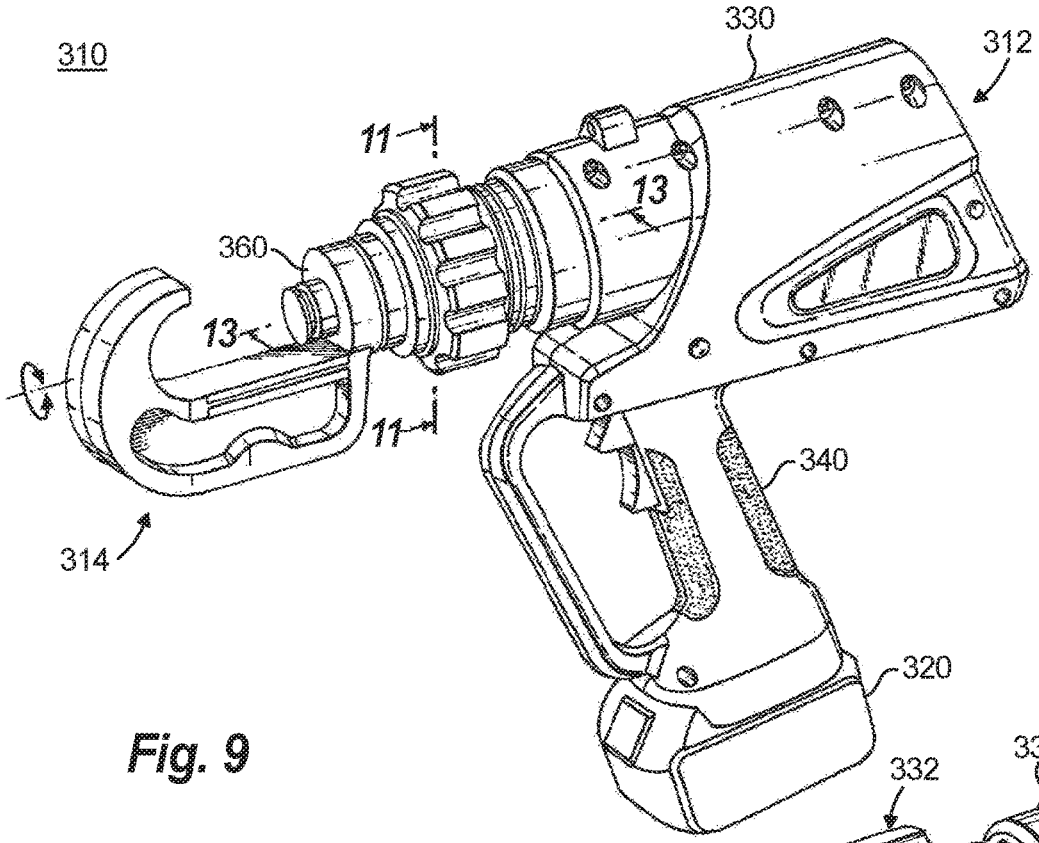
FIG. 9 is a front perspective view of another exemplary embodiment of a tool according to the present disclosure illustrating a tool frame and a working head of the tool.

As shown in FIG. 6, tool 210 includes a tool connecting portion 232. The tool connecting portion 232 has a slidable collar 240 surrounding an engagement cylinder 250. Working head 214 includes a head connecting portion 234 that has an engagement ring 236. The ring 236 of head 214 has a circumferential groove 238 on its outer surface. As shown in FIG. 8, when the working head 214 is connected with the main body 230, piston 260 extends from the tool 210 through the ring 236. Force applied to the piston 260 by the hydraulic system actuates portions of the working head 214 to perform work on a workpiece.

Figure 7:
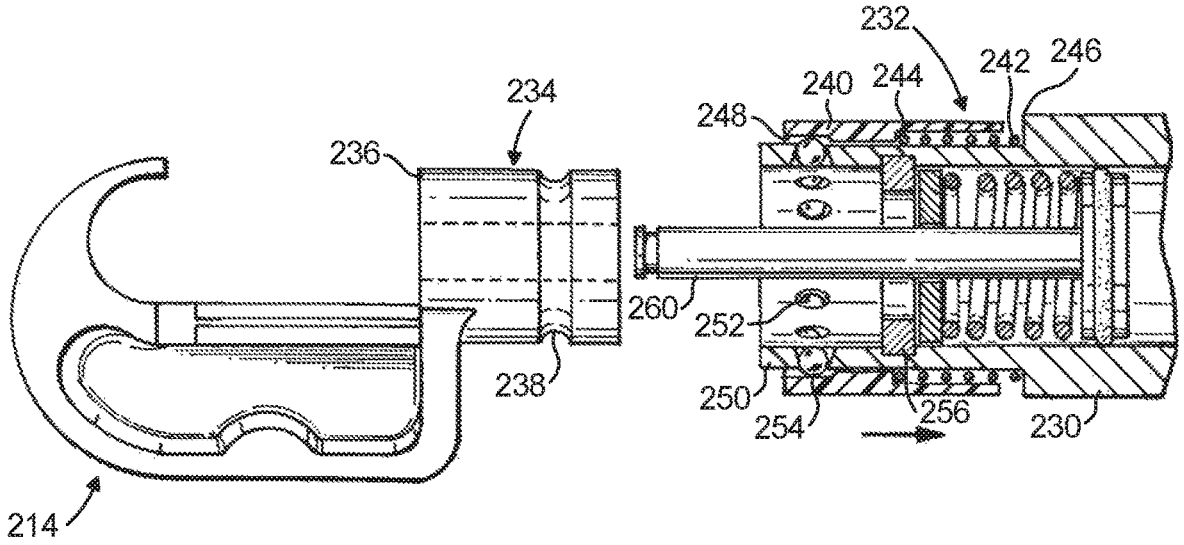
FIG. 7 is a side elevation view of the working head and cross section of a portion of the main body of the embodiment of FIG. 5 with the head separate from the main body.

FIG. 7 shows a cross section of the tool connecting portion 232 in relation to working head 214. The collar 240 includes a shoulder 244 along its inside circumference near the proximal end of the collar 240. Another shoulder 246 is provided on the main body 230. A biasing spring 242 is positioned between shoulders 244 and 246. In FIG. 7, the spring 242 is show in a compressed state with the collar 240 pulled in the proximal direction as shown by the arrow. A widened inner diameter portion 248 of the collar 240 is formed along the inside circumference of the collar 240 near its distal end.

The collar 240 surrounds the engagement cylinder 250. Cylinder 250 has an inner diameter slightly larger than the outer diameter of the ring 236 on the working head 214 to form a clearance fit with ring 236. Holes 252 are formed through the wall of the cylinder 250. Balls 254 are located within the holes 252. The diameter of the balls 254 is larger than the thickness of the cylinder 250. The diameter of the holes 252 on the inside surface of cylinder 250 is slightly less than the diameter of the balls 254 so the balls can protrude from the holes into the interior of cylinder but remain captive in the holes.

When the collar 240 is pulled in the proximal direction, as shown in FIG. 7, the widened portion of the collar 248 is positioned adjacent the holes 252, allowing the balls 254 to move away from the inner bore of the cylinder 250.

Working head 214 is connected with the main body 230 as follows. Collar 240 is pulled proximally, as shown in FIG. 7. The ring 236 of the working head 214 is inserted into the cylinder 250. The balls 254 are displaced away from interior of the cylinder 250 by the ring 236 and extend outward of the cylinder into the widened inner diameter portion 248 on the inside surface of the collar 240. This allows the proximal end of the ring to pass the holes 252 and contact a stop 256. As shown in FIG. 8, once the ring 236 is inserted fully against stop 256 in the cylinder 250, collar 240 is allowed to move distally by the force exerted by spring 242. The widened portion 248 along the inner diameter of the collar 240 is moved distal of the balls 254 so that the inner surface of the collar 240 presses the balls into the holes 252. The balls 254 extend into the groove 238 on the ring 236. Engagement of the balls 254 with the groove 238 locks the working head 214 to the cylinder 250. According to one aspect of the embodiment, engagement of balls 254 with groove 238 allows the head 214 to rotate with respect to the main body 230 about the axis of the piston 260.

To remove the working head 214 from the main body 230, collar 240 is pulled proximally to the position shown in FIG. 7. This aligns the widened portion 248 with the holes 252, allowing the balls 254 to move away from the groove 238. The working head 214 is then be pulled away from the main body 230 and removed.

Figure 10:
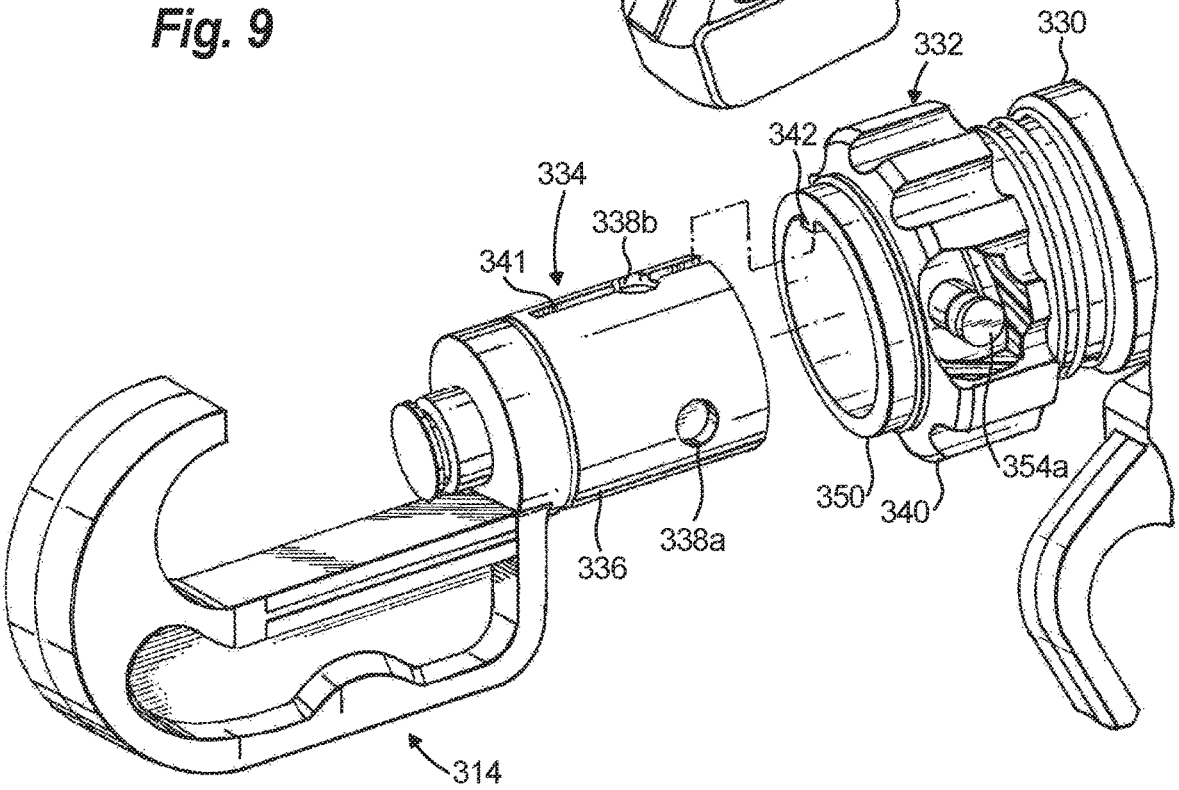
FIG. 10 is a front perspective view of the working head and a portion of the main body of the embodiment of FIG. 9 illustrating the working head separate from the tool frame.

FIGS. 9-13 show yet another embodiment of the disclosure. Tool 310 includes frame 312, handle 340, working head 314, main body 330, and hydraulic system similar to the embodiment described with respect to FIGS. 1-4. As shown in FIG. 10, at the distal end of the main body 330 is a tool connector portion 332. At the proximal end of the working head 314 is head connector portion 334.

Figure 11:
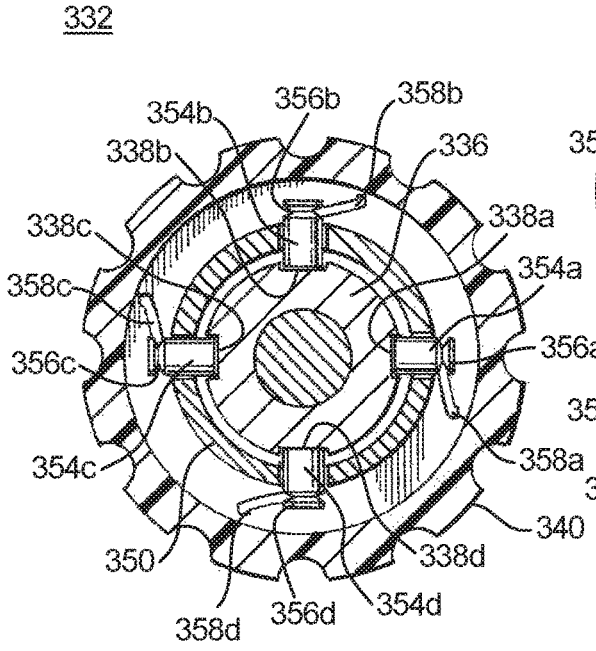
FIG. 11 is a cross sectional view of the connection between the working head and main body of the embodiment of FIG. 9.
Figure 13:
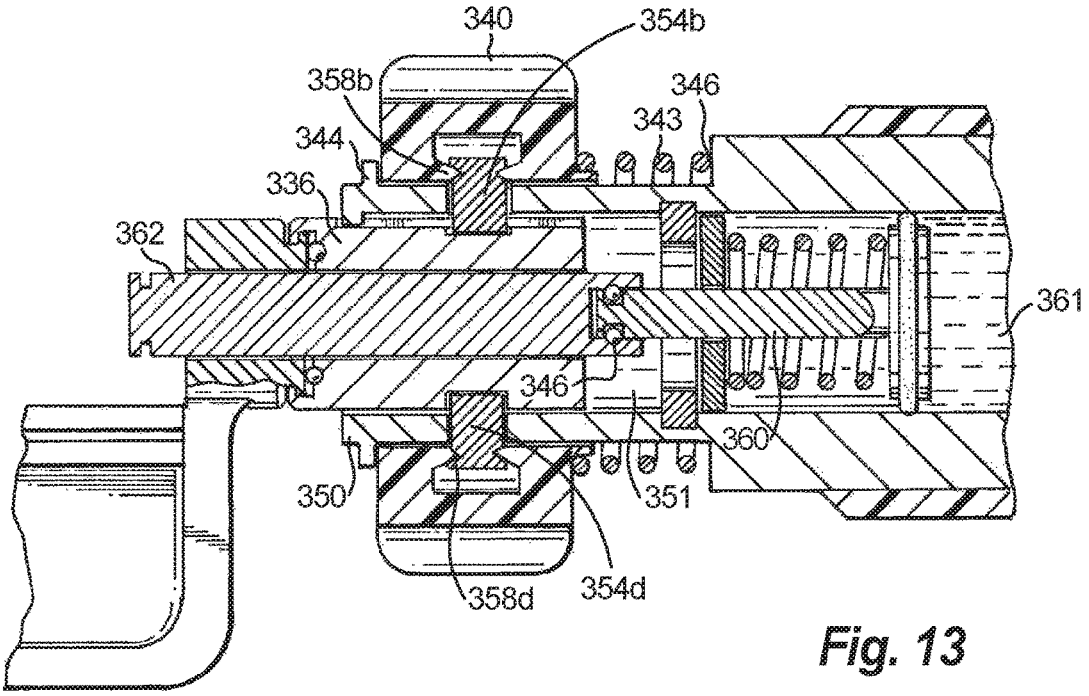
FIG. 13 is cross sectional view of the working head and a portion of the main body of the embodiment of FIG. 9 with the head connected with the main body.
Figure 14:
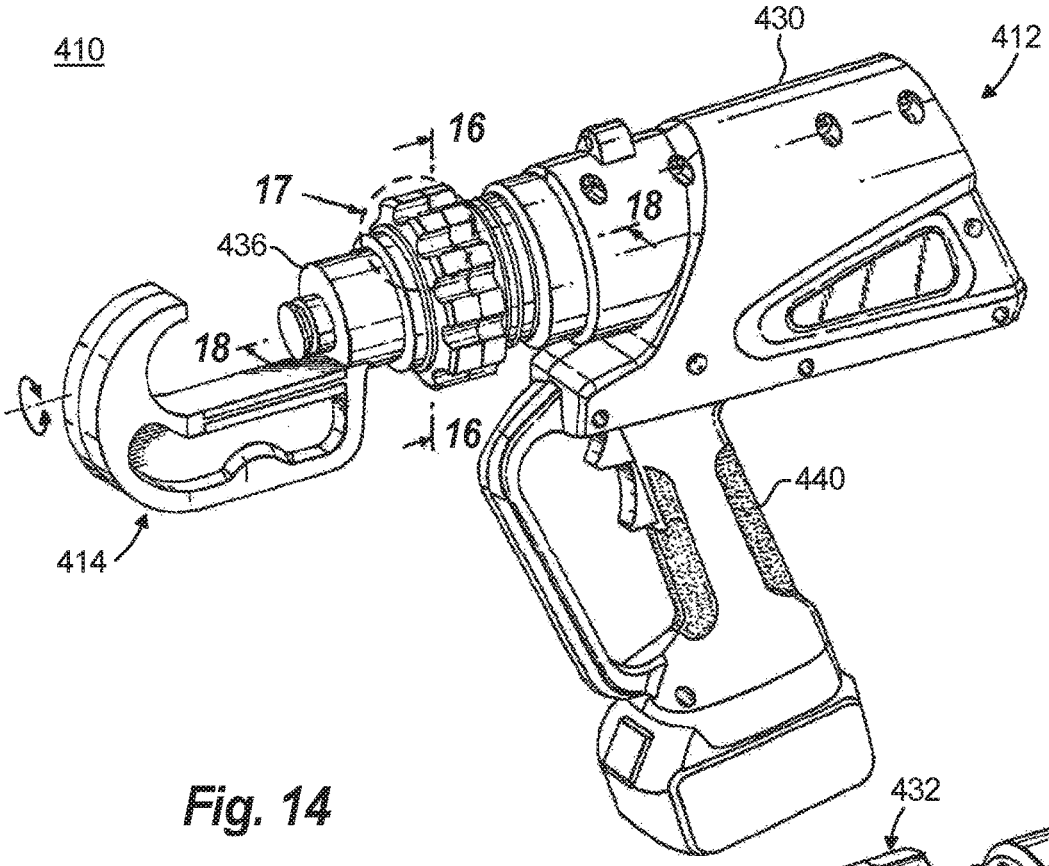
FIG. 14 is a front perspective view of another exemplary embodiment of a tool according to the present disclosure illustrating a tool frame and a working head of the tool.

Tool connector portion 332 includes rotatable collar 340 disposed around engagement cylinder 350. Extending through holes in the side of the cylinder 350 are pins 354*a-d*. FIG. 11 is a cross section of interconnected tool engagement portion 332 and head engagement portion 334 in the plane of collar 340 showing pins 354*a-d*. FIG. 13 shows a cross section of the head 314 engaged with the main body 330 in a plane along the axis of the piston 360. Each of the pins 354 *a-d* has a groove 356*a-d* near the end of the pin extending out from cylinder 350. As shown in the cross section of FIG. 13, the slots 358*a-d* of collar 340 have a narrow portion that engages with grooves 356*a-d* on each respective pin 354*a-d*. As shown in FIG. 11, slots 358*a-d* are angled with respect to the axis of rotation of the collar. The point where slots 358*a-d* engage respective pins 354*a-d* moves radially with respect to the cylinder 350 when the collar 340 is rotated. Rotating the collar 340 counter clockwise pulls the pins 354*a-d* away from the cylinder 350 and rotating the collar 340 clockwise pushes the pins 354*a-d* toward the cylinder 350.

As shown in FIG. 13, a torsion spring 343 is positioned proximal of the collar 340. One end of the spring is fixed to collar 340 and the other end is fixed to shoulder 346 of the main body 330. A stop 344 is provided on cylinder 350 distal of the collar 340. The torsion spring biases the collar to rotate in the clockwise direction so that, when no external rotational force is applied, collar 340 forces pins 354*a-d* inward of the cylinder to lock the head with the frame, as will be explained below. An interlock (not shown) may be provided on the main body adjacent to the rotatable collar 340. The interlock includes a switch that disables operation of the hydraulic system of the tool when the pins 354*a-d* are not in their fully locked position. The interlock enables operation of the hydraulic system when the pins are fully engaged, assuring that the head 314 is securely connected with the main body 330 when the tool is operated.

As shown in FIG. 10, the head engagement portion 334 includes ring 336. Holes 338*a-d* are provided on ring 336 (only two of the holes are visible in FIG. 10). Along the top surface of ring 336 is a groove 341 parallel with the axis of the ring. Ridge 342, shaped to fit into groove 341, is provided along the top of the inner surface of cylinder 350 along the axis of the cylinder. When the groove 341 and ridge 342 are engaged, the holes 338*a-d* are radially aligned with the positions of pins 354*a-d* extending through cylinder 350. FIG. 11 shows the pins 354*a-d* engaged with respective holes 338*a-d*.

To connect the working head 314 with the main body 330, a user rotates collar 340 counter-clockwise against the biasing force of torsion spring 343. Engagement of the pins 354*a-d* with slots 358*a-d* on the collar causes the pins to withdraw from the interior of the cylinder 350. Ring 336 is inserted into cylinder 350 with groove 341 aligned with ridge 342. The engagement of the ridge 341 and groove 342 assures that the head 314 is aligned with the main body 330 and prevents the head from rotating relative to the main body 350. FIG. 13 shows the ring 336 fully inserted into the cylinder 350 with the proximal end of the ring 336 in contact with stop 351. The user then releases collar 340, allowing the bias force of spring 343 to rotate the collar clockwise so that pins 354*a-d* are driven radially inward to engage with holes 338*a-d*, thus securing the head 314 to the main body 330. Torsion force applied by the spring keeps the pins engaged with the holes until the user applies a counter-clockwise force.

According to one embodiment, a detent mechanism is also provided to keep the collar 340 in a position where the pins 354*a-d* remain engaged with holed 358*a-d*. Such a mechanism may be formed by shaping slots 358*a-d* to provide an "over center" engagement with pins 354*a-d* so that rotation of the collar 340 presses the pins inward past a maximal point of insertion. To secure the head with the frame, the user applies a rotational force in the clockwise direction to turn collar 240 past the "over center" detent point to secure the pins into engagement with holes in the ring.

As shown in FIG. 13, a drive shaft 362 extends through ring 336 of the head 314. A hydraulic cylinder 361 is provided within the main body 330 to drive piston 360. A drive shaft engagement 346 connects the piston 360 with the drive shaft 362. According to one aspect, the engagement mechanism 346 is provided by a friction fit between a hole at the proximal end of the drive shaft 362 and pliant material, such as a neoprene o-ring, on the distal end of the piston 360. Driving force is communicated from the piston 360 to the drive shaft 362 in the distal direction by contact between the distal end of the piston and the proximal end of the drive shaft within the engagement mechanism. The friction fit of the pliant material provides traction between the drive shaft 362 and the piston 360 to pull the drive shaft back to the home position. According to another embodiment, instead of or in addition to a frictional engagement, drive shaft 362 and piston 360 may be coupled by a magnetic coupling.

To remove head 314 from the main body 330, collar 340 is rotated counterclockwise against the torsional force of spring 343 so that pins 354*a-d* are withdrawn from holes 338*a-d*. Head 314 is then pulled away from the main body 330, pulling the ring 336 out of the cylinder 350 and overcoming the friction fit of engagement mechanism 346 and piston 360.

Figure 12:
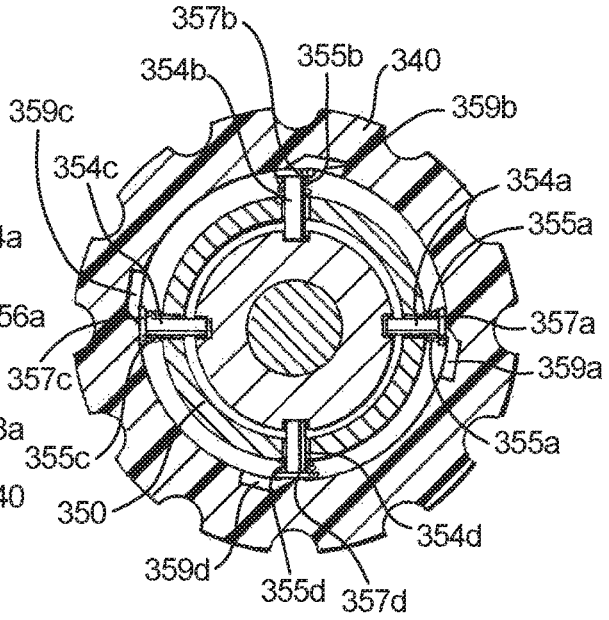
FIG. 12 is a cross sectional view of an alternative embodiment of the connection between the working head and main body of the embodiment of FIG. 9.

FIG. 12 shows an alternative embodiment of the mechanism shown in FIG. 11. Pins 354*a-d* extend through holes in collar 350 similar to the arrangement described with respect to FIG. 11. In this embodiment, springs 355*a-d* are disposed around the pins 354*a-d* between the heads of the pins 357*a-d* and the outer surface of cylinder 350. The springs 355*a-d* provide a biasing force pulling the pins radially outward from the cylinder 350. Slots 359*a-d* are provided on the inner surface of collar 340. When the collar 340 is rotated so that the heads of the pins 357*a-d* are aligned with the slots 359*a-d*, the pins are pulled radially outward by the bias force of the springs 355*a-d*. As with the embodiment described in regard to FIG. 11, to connect a head 314 with the main body 330, collar 240 is rotated so that pins 354*a-d* are withdrawn from the inside of the cylinder 350. The ring 336 of the head 314 is inserted into the cylinder 350. The collar 340 is rotated so that slots 359*ad-d* are rotated away from pins 354*a-d* causing the inside surface of the collar 340 to contact the heads 357*a-d* of the pins to push the pins inward, as shown in FIG. 12. Pins 354*a-d* extend inward of cylinder 350 and engage with holes 338*a-d* on the ring 336 locking the head 314 to the main body 330.

Embodiments described with regard to FIGS. 9-13 prevent the head 314 from rotating with respect to the main body 330. Rotation is prevented by both the engagement of ridge 342 and groove 341 on the cylinder 350 and ring 336, respectively, and by engagement of pins 354*a-d* and holes 338*a-d*.

Figure 15:
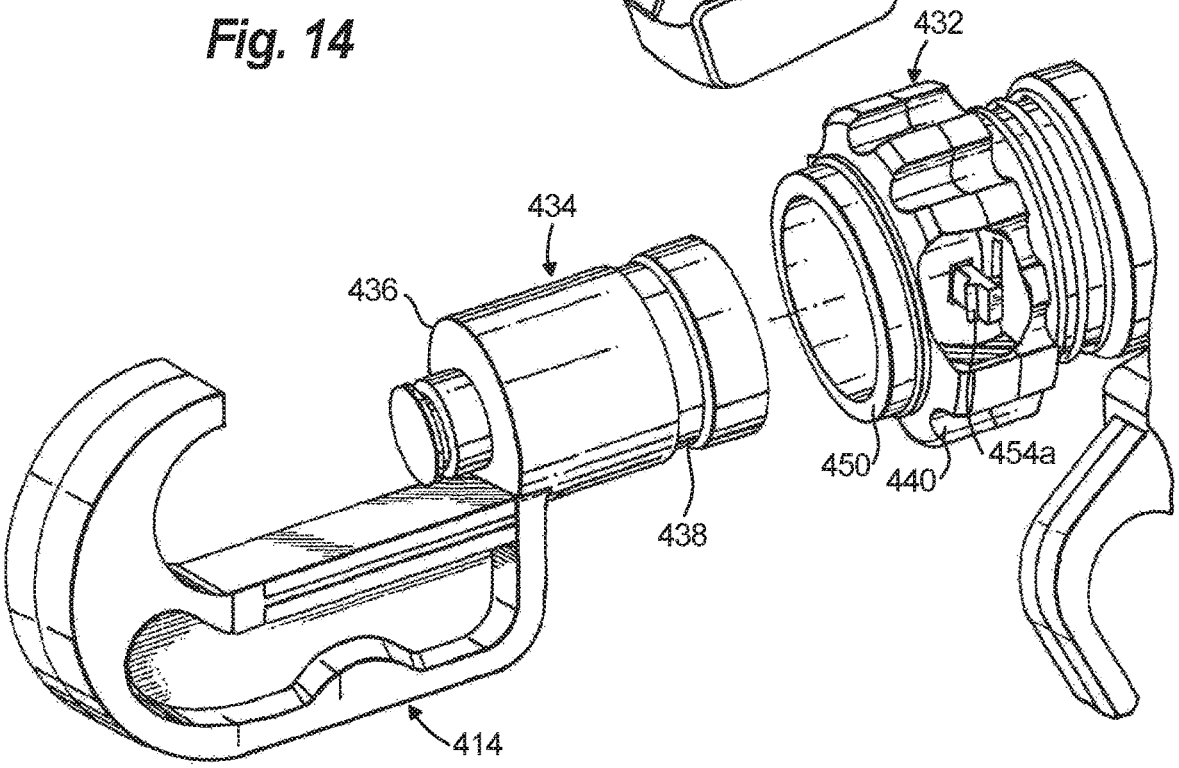
FIG. 15 is a front perspective view of the working head and a portion of the main body of the embodiment of FIG. 14 illustrating the working head separate from the tool frame.

FIGS. 14-18 show a further embodiment of the disclosure that provides a mechanism for locking an interchangeable working head 414 with the main body 430 of a tool 410. Tool 410 includes frame 412, handle 440, working head 414, main body 430, and hydraulic system similar to the embodiments described above. As shown in FIG. 15, at the distal end of the main body 430 is a tool connector portion 432. At the proximal end of the working head 414 is head connector portion 434.

Figure 16:
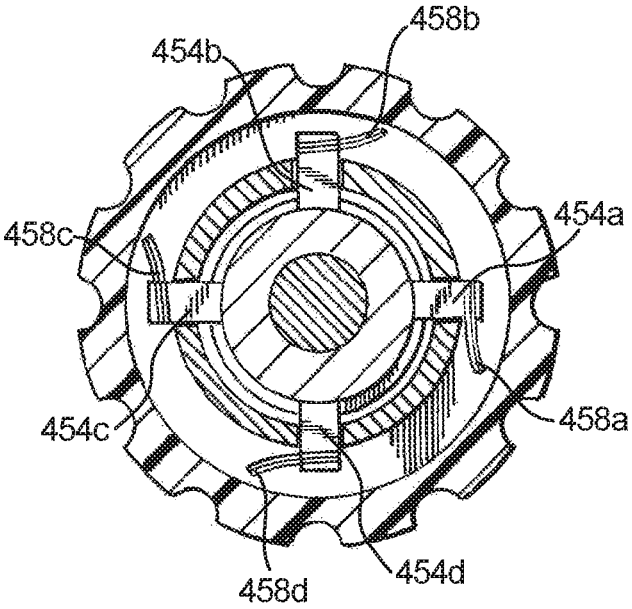
FIG. 16 is a cross sectional view of the connection between the working head and main body of the embodiment of FIG. 14.
Figure 17:
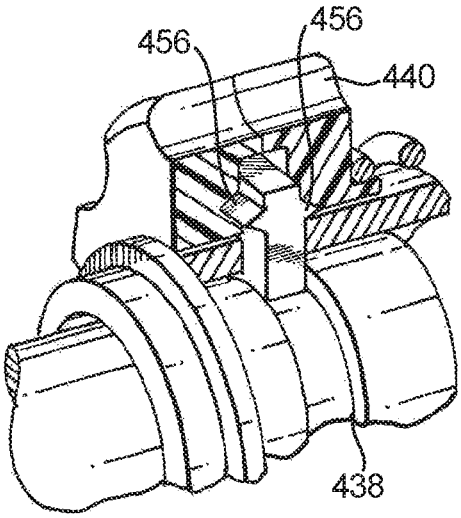
FIG. 17 is a side perspective view of a portion of the working head and cross section of a portion of the main body of the embodiment of FIG. 14 with the head connected with the main body.
Figure 18:
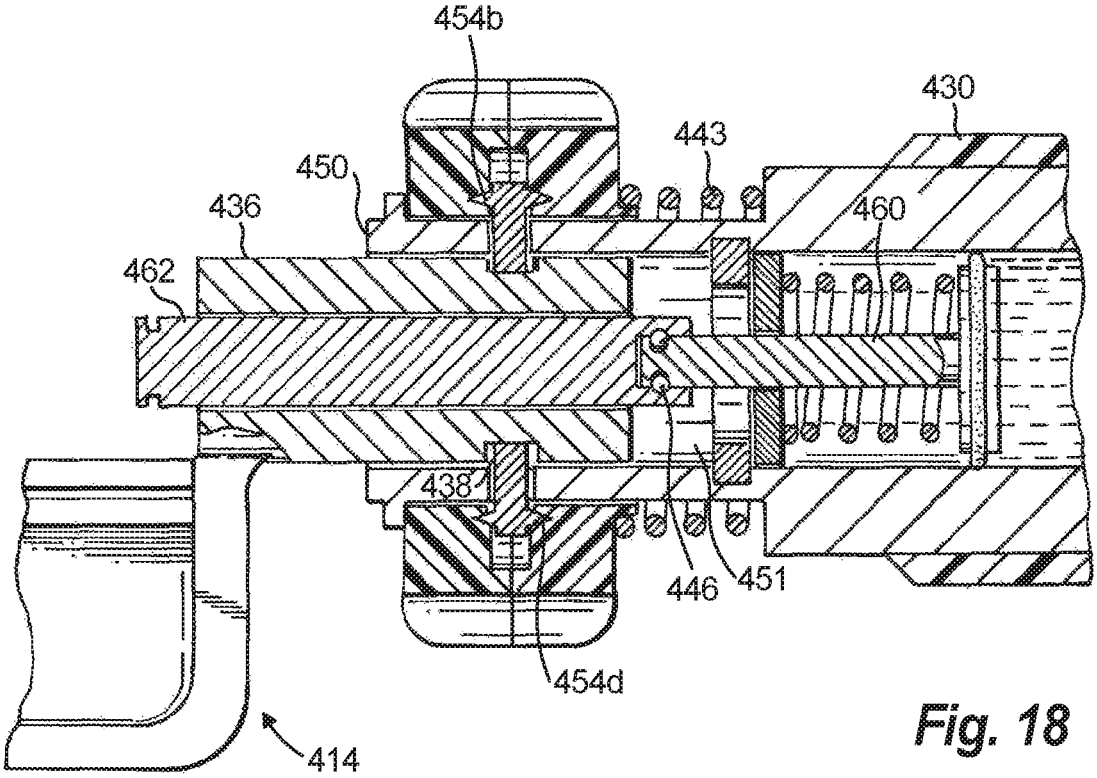
FIG. 18 is cross sectional view of portions of the working head and the main body of the embodiment of FIG. 14 with the head connected with the main body.

Tool connector portion 432 includes rotatable collar 440 disposed around engagement cylinder 450. Extending through holes in the side of the cylinder 450 are one or more pins 454*a-d*. FIG. 16 shows a cross section of the interconnected tool engagement portion 432 and head engagement portion 434 in the plane of collar 440. FIG. 18 shows a cross section of the head 414 engaged with the main body 430 in a plane parallel to the axis of piston 460. In this embodiment, four pins 454*a-d* are provided around the cylinder 450. Each of the pins 454 *a-d* has extensions 456 near the end of the pin extending out from cylinder 450, as shown in FIG. 17. Rotatable collar 440 includes slots 458*a-d* that engage with extensions 456 on respective pins 454*a-d*. As shown in FIG. 16, slots 458*a-d* are angled with respect to the axis of rotation of the collar so that when the collar 440 is rotated, the point where the extensions 456 on each of the pins 454*a-d* engages its respective groove moves radially with respect to the cylinder 450. Rotation of the collar in the counter clockwise direction pulls pins 454*a-d* away from cylinder 450. Rotation of the collar in the clockwise direction pushes the pins inward toward the cylinder 450. In an alternative embodiment, slots 458*a-d* are in the form of threads that extend partially or fully around a circumference of collar 440. Extensions 456 on the pins are curved to match the pitch of the groove or thread.

The head engagement portion 434 of head 414 includes engagement ring 436. A groove 438 is provided around the circumference of the ring 436. As shown in FIG. 17, groove 438 is shaped to accept insertion of pins 454*a-d* when the pins are extended inward of the cylinder 450.

As shown in FIG. 18, torsion spring 443 is fixed at its distal end with collar 440 and at its proximal end with main body 430. As with the previous embodiment, torsion spring 443 biases the collar 440 in the clockwise direction so that when no rotational force is applied to the collar, pins 454*a-d* are pushed inward of cylinder 450.

To connect the working head 414 with the main body 430, a user rotates collar 440 counterclockwise against the biasing force of spring 443 so that pins 454*a-d* are withdrawn from the interior of the cylinder 450. The ring 436 of the head 414 is inserted into the cylinder 450. FIG. 18 shows the ring 436 fully inserted into the cylinder 450 with the proximal end of the ring 436 in contact with stop 451. The user then releases the collar, which is driven clockwise by spring 443. Pins 454*a-d* are driven radially inward so that they engage with the groove 438, thus securing the head 414 to the main body 430. Because groove 438 is continuous about the ring 436, the head 414 can rotate with respect to the main body 430. As with the embodiment of FIGS. 9-13, drive shaft 462 is connected with piston 460 of the main body 430 by a drive shaft engagement 446, which may be a friction fit connection.

To remove head 414 from the main body 430, the user rotates collar 440 counter-clockwise so that pins 454*a-d* are withdrawn from engagement with groove 438. The user pulls head 414 away from the main body 430, pulling the ring 436 out of the cylinder 450.

Figure 19:
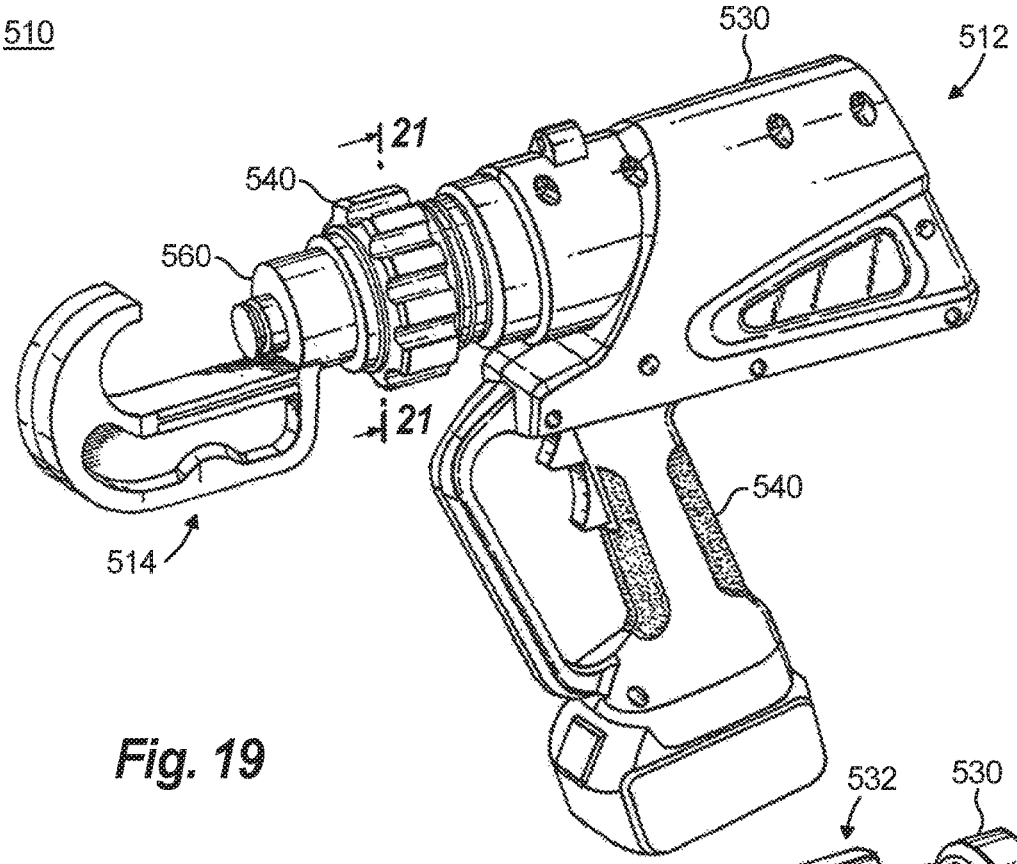
FIG. 19 is a front perspective view of another exemplary embodiment of a tool according to the present disclosure illustrating a tool frame and a working head of the tool.
Figure 20:
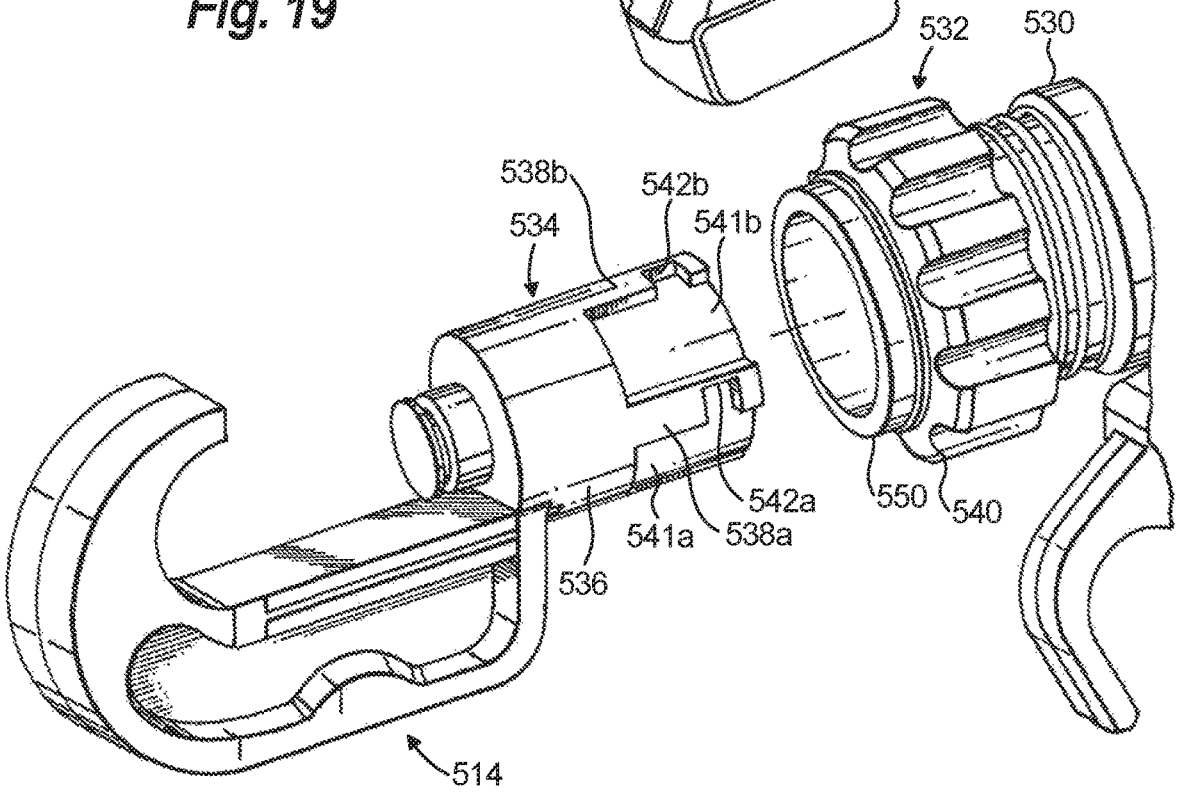
FIG. 20 is a front perspective view of the working head and a portion of the main body of the embodiment of FIG. 19 illustrating the working head separate from the tool frame.
Figure 21:
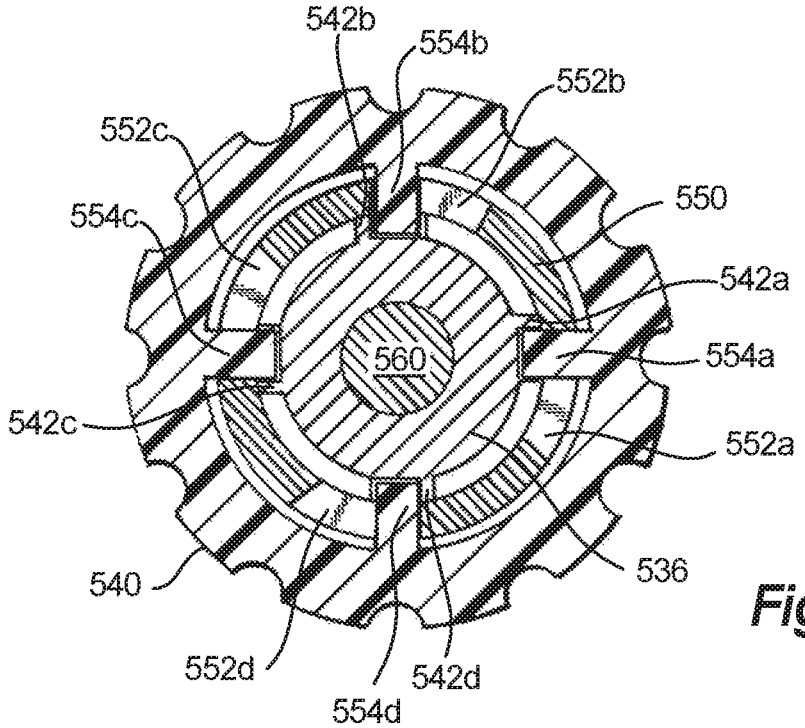
FIG. 21 is a cross sectional view of the connection between the working head and main body of the embodiment of FIG. 19.

FIGS. 19-21 show another embodiment of the disclosure. Tool 510 includes frame 512, handle 540, working head 514, main body 530, and hydraulic system similar to the embodiments described above. As shown in FIG. 20, the distal end of the main body 530 includes tool connector portion 532. At the proximal end of the working head 514 includes head connector portion 534.

Tool connector portion 532 includes rotatable collar 540 disposed around engagement cylinder 550. As shown in the cross section in FIG. 21, collar 540 includes extensions 554*a-d*. Cylinder 550 includes slots 552*a-d*. Extensions 554*a-d* extend through corresponding slots 552*a-d* into the interior of cylinder 550.

As shown in FIG. 20, head engagement portion 534 includes ring 536. Ridges 538*a-d* are formed on the surface of ring 536. In the view shown in FIG. 20, only two of the ridges are visible. Ridges 538*a-d* include respective notches 542*a-d*. Between the ridges 538*a-d* are relieved areas 541*a-d*. The diameter of the head connecting portion 534 in the area of the ridges 538*a-d* is slightly less than the inner diameter of cylinder 550. This allows head connecting portion 534 to be inserted into the cylinder 550 of the tool connecting portion with a small amount of clearance between the ridges 538*a-d* and the inside of the cylinder 550.

As shown in FIG. 21, when head 514 is connected with main body 530, the inward pointing ends of the extensions 554*a-d* of collar 540 are disposed in corresponding notches 542*a-d* of head 514. Engagement of extensions 554*a-d* with notches 542*a-d* prevents ring 536 from moving distally with respect to cylinder 550, thus locking head 514 to the main body 530.

To connect the working head 514 with the main body 530, collar 540 is rotated clockwise so that extensions 554*a-d* align with relieved portions 541*a-d* of ring 536. This allows ridges 538*a-d* to pass between extensions 554*a-d*. Ring 536 of the head 514 is inserted into the cylinder 550 of the main body 530. When the ring 536 is fully inserted into cylinder 550, the proximal end of ring 536 abuts a stop (not shown) at the proximal end of the cylinder. In this configuration, notches 542*a-d* are aligned with extensions 554*a-d*. Collar 540 is then rotated counter clockwise so that extensions 554*a-d* are moved into respective slots 542*a-d*, as shown in the cross section of FIG. 21.

To remove head 514 from the main body 530, collar 540 is rotated in a clockwise direction so that extensions 554*a-d* are moved out from notches 542*a-d* and aligned with relieved portions 541*a-d*. The head 514 is pulled away from the main body 530, pulling the ring 536 out of the cylinder 550.

Figure 22:
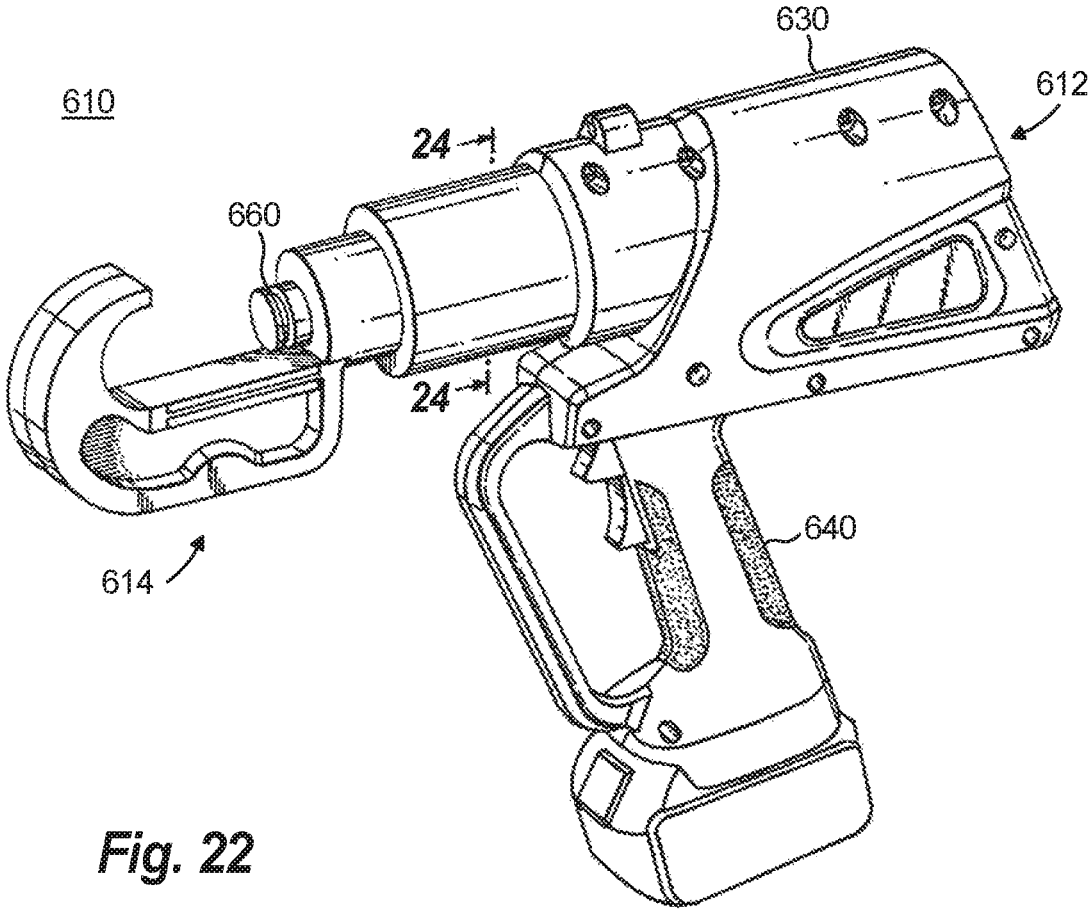
FIG. 22 is a front perspective view of another exemplary embodiment of a tool according to the present disclosure illustrating a tool frame and a working head of the tool.
Figure 23:
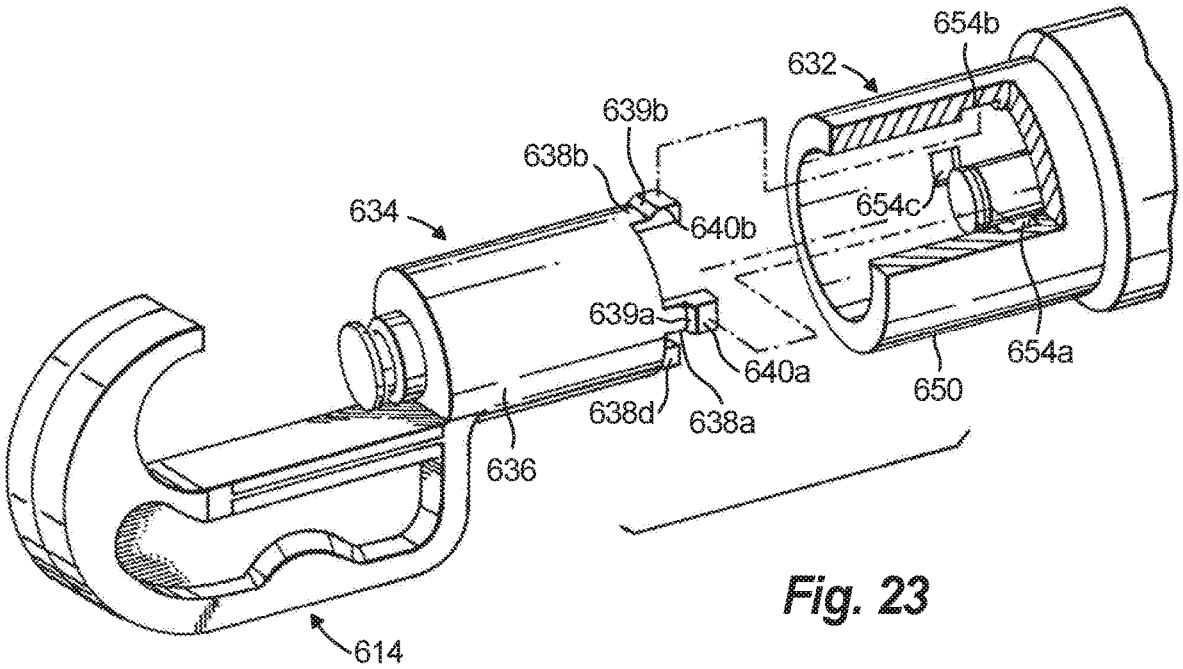
FIG. 23 is a front perspective view of the working head and a portion of the main body of the embodiment of FIG. 22 illustrating the working head separate from the tool frame.
Figure 24:
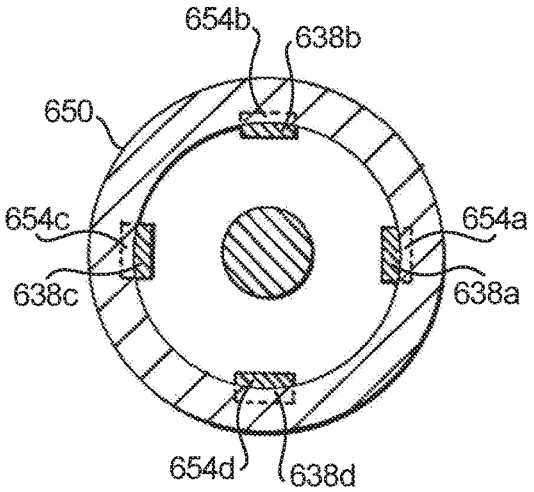
FIG. 24 is a cross sectional view of the connection between the working head and main body of the embodiment of FIG. 22.

FIGS. 22-24 show another embodiment of the disclosure. Tool 610 includes frame 612, handle 640, working head 614, main body 630, and hydraulic system similar to the embodiments described above. As shown in FIG. 23, the distal end of the main body 630 includes tool connector portion 632. At the proximal end of the working head 614 is head connector portion 634.

As shown in FIG. 23, head engagement portion 634 includes a ring 636. Arms 638*a-d* extend in the proximal direction from the ring. At the proximal end of each arm is an extension 640*a-d* facing radially outward from the ring 636. The outer diameter of ring 636 and arms 638*a-d* is slightly less than the inner diameter of cylinder 650 so that a clearance fit is provide between the ring and cylinder. Tool connector portion 632 includes an engagement cylinder 650. The outer diameter of extensions 640*a-d* is larger than the inner diameter of cylinder 650. Notches 654*a-d* are provided on the interior surface of cylinder 650.

As shown in FIG. 24, when head 614 is connected with main body 630, extensions 640*a-d* are disposed in corresponding notches 654*a-d*. Engagement of extensions 640*a-d* with notches 654*a-d* prevents ring 636 from moving or rotating with respect to cylinder 650, thus locking head 614 to the main body 630.

According to an alternative embodiment, instead of discrete notches 654*a-d*, a continuous groove extends around the inner surface of cylinder 650. The groove is shaped to engage with extensions 640*a-d*. An aspect of this embodiment is that the head 614 is fixed to the main body 630, but can rotate about the axis of the piston.

To connect the working head 614 with the main body 630, arms 638*a-d* on ring 636 are compressed radially inward so that extensions 640*a-d* fit within the cylinder 650. Arms 640*a-d* each may include a sloped region on its proximal surface that engages the distal lip of the cylinder 650 to push the arms radially inward as the arms are forced into the cylinder. The ring 636 is pushed into cylinder 650 and adjusted so that extensions 640*a-d* align with respective notches 654*a-d*. Recoil from the compressed arms 638*a-d* pushes extensions 638*a-d* radially outward into notches 654*a-d*, thus locking head 614 with main body 630. Arms 638*a-d* also include a sloped region 639*a-d* on their proximal sides. To remove the head 614 from the main body 630, the head is pulled in the distal direction. Sloped regions 639*a-d* engage with the distal edges of notches 654*a-d* and the sloped region exerts a radially directed inward force as the sloped region 639*a-d* rides up the distal edges of the notches until the arms are free of the notches. Ring 636 can then be pulled out of cylinder 650 and the head 614 separated from the main body 630.

As shown throughout the drawings, like reference numerals designate like or corresponding parts. While illustrative embodiments of the present disclosure have been described and illustrated above, it should be understood that these are exemplary of the disclosure and are not to be considered as limiting. Additions, deletions, substitutions, and other modifications can be made without departing from the spirit or scope of the present disclosure. Accordingly, the present disclosure is not to be considered as limited by the foregoing description.

What is claimed is:

1. A hydraulic tool comprising:
a tool frame comprising:
a piston adapted to exert a force in a distal direction; and
a tool connecting portion; and
a tool head comprising:
an impactor adapted to apply the force to a workpiece; and
a head connecting portion,
wherein engagement of the tool connecting portion with the head connecting portion removably connects the tool head with the tool frame and engages the piston with the impactor,
wherein the tool connecting portion comprises a T-shaped slot, wherein the piston at least partially protrudes within the T-shaped slot,
wherein the head connecting portion comprises a ring connected with the tool head and two arms connected with the ring, wherein the arms extend in a proximal direction from the tool head wherein the arms are separated from one another by a gap between the arms extending a full width in a first direction perpendicular to the distal direction, wherein the arms form a T-shaped cross section sized to slide into the T-shaped slot, wherein the head connecting portion and the tool connecting portion engage with one another by sliding the arms into the T-shaped slot in a second direction perpendicular to the distal direction and perpendicular to the first direction,
wherein the gap is distal of the ring, and
wherein the piston extends in the distal direction through the gap.

2. The tool of claim 1, wherein one or more of the two arms comprise a distal-facing engagement surface and wherein the T-shaped slot comprises a proximal-facing engagement surface and wherein, when the head connecting portion and the tool connecting portion are engaged, the distal-facing and proximal-facing engagement surfaces contact one another at an oblique angle to the distal direction.

3. The tool according to claim 1, further comprising a locking mechanism, the locking mechanism releasably locking the head connecting portion and the tool connecting portion into engagement.

4. The tool of claim 3, wherein the locking mechanism comprises a hole on one of the head connecting portion and the tool connecting portion and ball biased by a spring to engage with the hole on the other of the head connecting portion and the tool connecting portion.

5. The tool of claim 1, further comprising a piston connector, the piston connector releasably connecting the piston with the impactor when the head connecting portion and the tool connecting portion are engaged.

6. The tool of claim 5, wherein the piston includes a groove near its distal end and wherein the piston connector comprises a T-shaped engagement adapted to slideably engage with the groove.

7. A hydraulic tool comprising:
a tool frame comprising:
a piston adapted to exert a force in a distal direction; and
a tool connecting portion; and
a tool head comprising:
an impactor adapted to apply the force to a workpiece; and
a head connecting portion,
wherein engagement of the tool connecting portion with the head connecting portion removably connects the tool head with the tool frame and engages the piston with the impactor,
wherein the tool connecting portion comprises:
a cylinder;
a rotatable collar around the cylinder;
one or more pins extending through a side of the cylinder and operatively connected with the collar, wherein a rotation of the collar in a first direction causes the pins to move into an interior of the cylinder and a rotation in a second direction causes the pins to move out from the interior of the cylinder, and
wherein the head connecting portion comprises:
a shaft disposed at the proximal end of the head and sized to fit into the cylinder; and
one or more engagement surfaces on the outer surface of the shaft,
wherein when the pins are moved into the interior of the cylinder the pins engage with the one or more engagement surfaces.

8. The tool of claim 7, further comprising a torsion spring connected with the collar and adapted to bias the collar in the first direction.

9. The tool claim 7, wherein the one or more engagement surfaces comprises a plurality of holes on the surface of the shaft positioned to correspond to respective ones of the pins when the tool connecting portion with the head connecting portion are engaged.

10. The tool of claim 7, wherein the one or more engagement surfaces comprise a circumferential groove around the shaft.

11. A hydraulic tool comprising:

a tool frame comprising:

a piston adapted to exert a force in a distal direction; and a tool connecting portion; and a tool head comprising:

an impactor adapted to apply the force to a workpiece; and a head connecting portion, wherein engagement of the tool connecting portion with the head connecting portion removably connects the tool head with the tool frame and engages the piston with the impactor, wherein the tool connecting portion comprises a T-shaped slot, wherein the T-shaped slot comprises two openings at opposing ends of the T-shaped slot along an insertion direction perpendicular to the distal direction, wherein the piston at least partially protrudes within the T-shaped slot;

wherein the head connecting portion comprises two arms connected with the tool head and extending in a proximal direction separate from one another defining a gap between the arms, wherein the arms are separated from one another by a gap spanning a space between the arms extending a full width in a first direction perpendicular to the distal direction and perpendicular to the insertion direction, wherein the arms form a T-shaped cross section sized to slide into the T-shaped slot, wherein the head connecting portion and the tool connecting portion engage with one another by sliding the arms into the T-shaped slot along the insertion direction, and wherein the arms are adapted to slide into the T-shaped slot through one or the other of the two openings.

* * * * *